US006146198A

United States Patent [19]

Maeda

[11] Patent Number: 6,146,198

[45] Date of Patent: Nov. 14, 2000

[54] WATERPROOF CONNECTOR

[75] Inventor: Akira Maeda, Shizuoka, Japan

[73] Assignee: Yazaki Corporation, Tokyo, Japan

[21] Appl. No.: 09/390,021

[22] Filed: Sep. 3, 1999

[30] Foreign Application Priority Data

Sep. 8, 1998 [JP] Japan ..... 10-254120

[51] Int. Cl.[7] ..... H01R 13/40

[52] U.S. Cl. ..... 439/587; 439/596

[58] Field of Search ..... 439/271, 273, 439/274, 275, 445, 446, 447, 465, 467, 468, 587, 596

[56] References Cited

U.S. PATENT DOCUMENTS

| | | | |
|---|---|---|---|
| 5,197,899 | 3/1993 | Akeda | 439/271 |
| 5,240,431 | 8/1993 | Yagi et al. | 439/271 |
| 5,545,054 | 8/1996 | Benes et al. | 439/467 |
| 5,607,318 | 3/1997 | Wakata et al. | 439/274 |
| 5,622,512 | 4/1997 | Uchida et al. | 439/271 |
| 5,766,039 | 6/1998 | Abe | 439/587 |
| 5,997,351 | 12/1999 | Okabe | 439/587 |
| 6,030,237 | 2/2000 | Roth | 439/157 |
| 6,059,603 | 5/2000 | Sato et al. | 439/468 |
| 6,074,238 | 6/2000 | DeRoss et al. | 439/409 |

FOREIGN PATENT DOCUMENTS

| | | | |
|---|---|---|---|
| 4-81471 | 7/1992 | Japan | H01R 13/52 |

*Primary Examiner*—Brian Sircus
*Assistant Examiner*—Thanh-Tam Le
*Attorney, Agent, or Firm*—Sughrue, Mion, Zinn, Macpeak & Seas, PLLC

[57] ABSTRACT

A waterproof connector (1) includes a connector housing (2) which includes terminal receiving chambers (3) for respectively receiving connection terminals (41), secured respectively to wires (40), and a wire support portion (4) extending rearwardly from the terminal receiving chambers (3). The waterproof connector (1) also includes a cover (8) for covering the wire support portion (4) of the connector housing (2), and a housing-side seal member (10) and a cover-side seal member (11) which hold the wires (40) therebetween, and achieve a waterproof effect. Housing-side slanting portions (16), each having a slanting surface (15) slanting rearwardly, are respectively formed on opposite inner side portions on the wire support portion (4) of the connector housing (2). Cover-side slanting portions (18), each having a slanting surface (17) corresponding to the slanting surface (15) of the associated housing-side slanting portion (16), are respectively formed on an inner surface of the cover (8). The housing-side seal member (10) has a rectangular frame-like shape, and has side seal portions (opposite side portions) (19), a front seal portion (front portion) (20) and a rear seal portion (rear portion) (21).

5 Claims, 4 Drawing Sheets

WATERPROOF CONNECTOR

BACKGROUND OF THE INVENTION

1. Field of the Invention

The present invention relates to a waterproof connector used in an automobile or the like. More particularly, the present invention relates to a waterproof connector in which seal members are pressed and held between a cover and a connector housing.

The present application is based on Japanese Patent Application No. Hei. 10-254120, which is incorporated herein by reference.

2. Description of the Related Art

For example, Unexamined Japanese Utility Model Publication No. Hei. 4-81471 discloses the related waterproof connector used for an electrical connection within an engine room of a vehicle or the like which can be exposed to rain water.

As shown in FIG. 5, the waterproof connector 51 comprises a connector housing 52 which includes a terminal receiving chamber 53 for receiving a connection terminal 41, secured at its rear end to an end portion of a wire 40, and a wire support portion 54 extending rearwardly from the terminal receiving chamber 53.

The waterproof connector also comprises a cover 58, which covers the wire support portion 54, and is retained in a closed condition by retaining holes 56 and retaining projections 57 (which serve as cover retaining portions 55), a housing-side seal member 60, and a cover-side seal member 62, the two seal members 60 and 62 holding the wire 40 therebetween to achieve a waterproof effect.

More specifically, an upper surface of a front end of the cover 58 is connected to an upper surface of a rear end of the terminal receiving chamber 53 by a flexible hinge 59. The housing-side seal member 60 and the cover-side seal member 62 are made of an elastic material such as soft rubber, and a housing-side groove 61 and a cover-side groove 63 are formed respectively in the seal members 60 and 62 so that the wire 40 can be suitably held therebetween in a waterproof manner.

The cover-side seal member 62 has an L-shape, and covers an inner surface of the cover 58, and a cover-side slanting surface 66 is formed at a front end of this seal member 62. When the cover 58 covers the wire support portion 54, the cover-side slanting surface 66 is held against a housing-side slanting surface 67, formed at an upper portion of the rear end of the terminal receiving chamber 53, thereby achieving a waterproof effect.

A retaining groove 42 is formed in a lower side of the connection terminal 41, and a housing lance (not shown), formed on a bottom plate 64 of the connector housing 52, can be retainingly engaged in this retaining groove 42.

In the waterproof connector 51 of the above construction, when the connection terminal 41, secured to the end portion of the wire 40, is inserted into the terminal receiving chamber 53, the housing lance is retainingly engaged in the retaining groove 42, and also the lower surface of the wire 40 is supported by the housing-side groove portion 61 of the housing-side seal member 60. Then, when the hinge 59 is turned, so that the cover 58 is closed to cover the wire support portion 54, the retaining holes 56 are retainingly engaged with the retaining projections 57, respectively, and the cover-side groove portion 63 is pressed against the upper surface of the wire 40, and cooperates with the housing-side groove portion 61 to firmly hold the wire 40 therebetween.

In this condition, the lower end (edge) of the cover-side seal member 62 is pressed hard against the upper end (edge) of the housing-side seal member 60, and also the slanting surface 66 of the cover-side seal member 62 is pressed hard against the housing-side slanting surface 67. And besides, opposite side surfaces of the cover-side seal member 62 are held in contact with opposite inner side surfaces of the wire support portion 54, respectively, and therefore the intrusion of water into the wire support portion 54 and the terminal receiving chamber 53 is prevented.

In the above waterproof connector 51, however, the opposite side surfaces of the cover-side seal member 62, though held in contact respectively with the opposite inner side surfaces of the wire support portion 54, can not be pressed hard against these opposite inner side surfaces, respectively, and therefore a sufficient waterproof effect can not be achieved at the inner side surfaces of the wire support portion 54, which has resulted in a problem that water and others under high pressure intrude into the wire support portion.

In order to overcome the above problem, it is necessary to increase the area of contact between the side surface of the cover-side seal member 60 and the inner side surface of the wire support portion 54. However, this leads to possibilities that the shape of the cover-side seal member 62 is much deformed, and that a large force is required for closing the cover, so that the hinge 59 can be broken.

SUMMARY OF THE INVENTION

With the above problems in view, it is an object of the present invention to provide a waterproof connector in which a waterproof effect at an inner side surface of a wire support portion of a connector housing is enhanced, thereby positively preventing the intrusion of water into the connector housing.

To achieve the above object, according to the first aspect of the present invention, there is provided a waterproof connector which comprises a connector housing including a terminal receiving chamber for receiving a connection terminal secured to an end portion of a wire, and a wire support portion rearwardly extending from the terminal receiving chamber, a cover which covers the wire support portion, and is retained on the connector housing by a cover retaining portion, at least two housing-side slanting portions, between which the wire is arranged, each having a slanting surface, the housing-side slanting portions being formed on the wire support portion, at least two cover-side slanting portions each having a slanting surface, the cover-side slanting portions being formed on the cover, a cover-side seal member attached to the cover, and a housing-side seal member attached to the wire support portion, the housing-side seal member including a first seal portion which is associated with the cover-side seal member so as to hold the wire therebetween, and side seal portions respectively pressed and held between the housing-side slanting portions and the cover-side slanting portions.

Accordingly, merely by pressing the cover generally vertically toward the wire support portion so as to retain the cover in its closed position by the cover retaining portion, each of the side seal portions is firmly pressed and held between the associated housing-side and cover-side slanting portions, so that a waterproof effect can be positively achieved at the opposite inner side portions of the wire support portion, and therefore there can be obtained the waterproof connector of high reliability.

According to the second aspect of the present invention, preferably, the cover-side seal member is located at a rear end portion of the cover.

Further, according to the third aspect of the present invention, preferably, the waterproof connector further comprises a housing-side pressing portion interconnecting front ends of the housing-side slanting portions, and a cover-side pressing portion formed on the cover, wherein the housing-side seal member further includes a second seal portion, the second seal portion is pressed and held between the housing-side pressing portion and the cover-side pressing portion.

Therefore, the housing-side seal member is firmly pressed and held between the wire support portion and the cover not only at the side seal portions but also at the front and rear (second and first) seal portions, and therefore the housing-side seal member positively achieves the waterproof effect, and there can be obtained the waterproof connector of higher reliability.

Furthermore, according to the fourth aspect of the present invention, preferably, the first seal portion interconnects rear end portions of the side seal portions of the housing-side seal member, and the second seal portion interconnects front end portions of the side seal portions of the housing-side seal member.

DETAILED DESCRIPTION OF THE PREFERRED EMBODIMENT

One preferred embodiment of a waterproof connector of the present invention will now be described in detail with reference to FIGS. 1 to 4.

Figure 1:
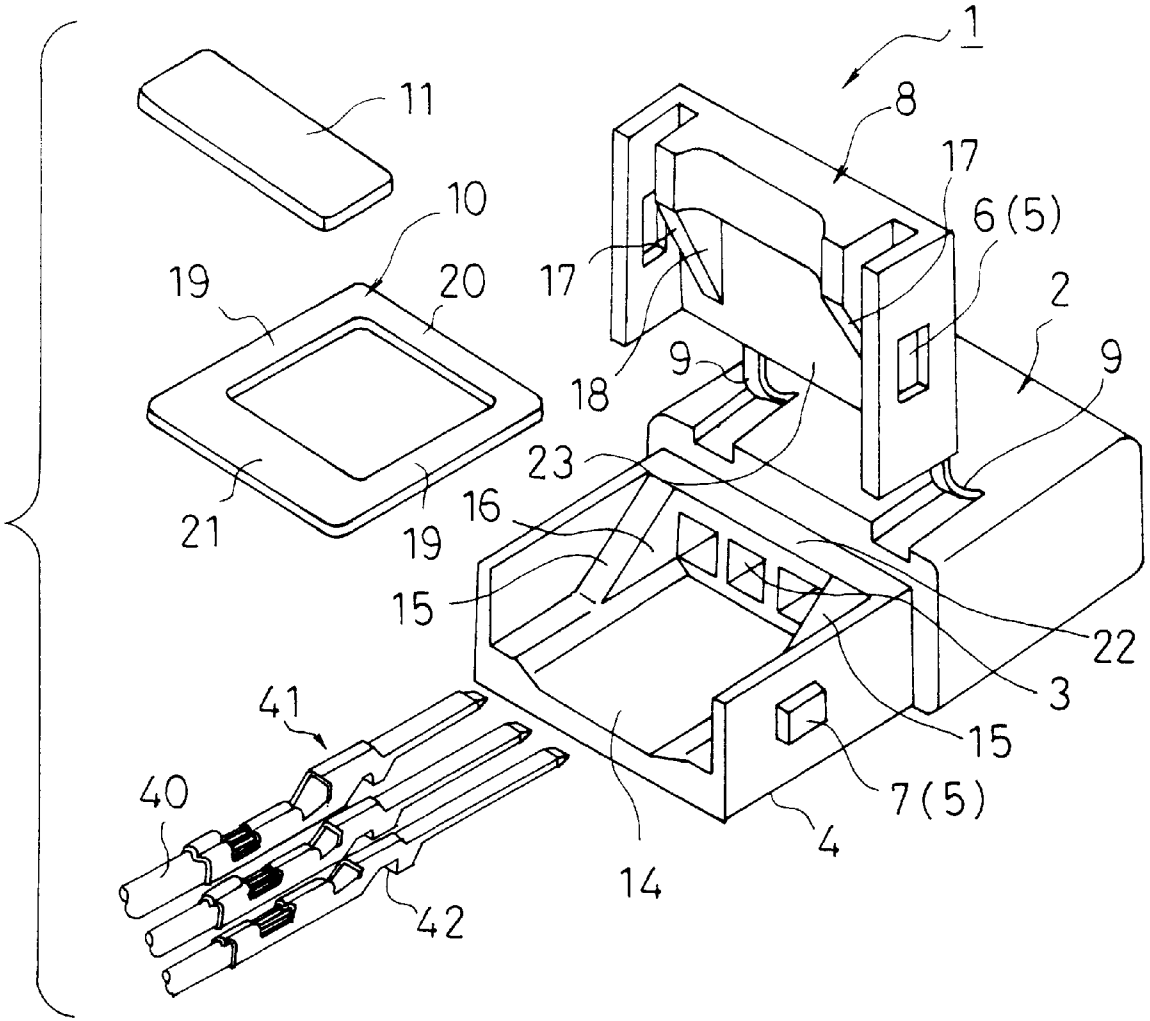
FIG. 1 is an exploded, perspective view of one preferred embodiment of a waterproof connector of the present invention.
Figure 2:
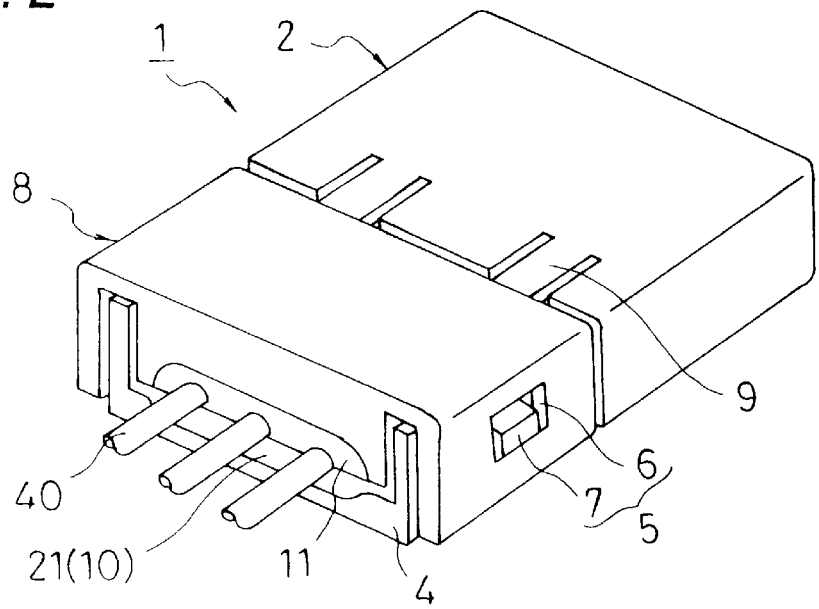
FIG. 2 is a perspective view of the waterproof connector of FIG. 1 in its assembled condition.

As shown in FIG. 1, a waterproof connector 1 of this embodiment comprises a connector housing 2 which includes terminal receiving chambers 3 for respectively receiving connection terminals 41, secured respectively to end portions of wires 40, and a wire support portion 4 extending rearwardly from the terminal receiving chambers 3. The waterproof connector 1 also comprises a cover 8, which covers the wire support portion 4, and is retained on the connector housing 2 by retaining holes 6 and retaining projections 7 (which serve as cover retaining portions 5), and a housing-side seal member 10 and a cover-side seal member 11 which hold the wires 40 therebetween, and are made of a soft elastic material so as to achieve a waterproof effect.

More specifically, an upper surface of a front end of the cover 8 is connected to an upper surface of a rear end of the terminal receiving chambers 3 by a flexible hinge 9. A retaining groove 42 is formed in a lower side of each of the connection terminals 41, and housing lances (not shown), formed on a bottom plate 14 of the connector housing 2, can be retainingly engaged in the retaining grooves 42, respectively.

Housing-side slanting portions 16 are respectively formed on opposite inner side portions on the wire support portion 4, and each of these slanting portions 16 has a slanting surface 15 which is slanting downwardly rearwardly (in a direction opposite to a connector fitting direction), that is, slanting upwardly forwardly. Cover-side slanting portions 18 are respectively formed on an inner surface of the cover 8, and each of these slanting portions 18 has a slanting surface 17 which corresponds to the slanting surface 15 of the associated housing-side slanting portion 16, and is slanting downwardly rearwardly for surface-to-surface contact with the slanting surface 15.

The housing-side seal member 10 has a rectangular frame-like shape, and has side seal portions 19 (defining opposite side portions thereof, respectively) each adapted to be held between the associated housing-side slanting portion 16 and cover-side slanting portion 18.

When the cover is closed, a front seal portion 20 (defining a front portion) of the housing-side seal member 10 is pressed and held between a housing-side pressing portion 22, interconnecting front ends of the housing-side slanting portions 16, and a cover-side pressing portion 23 formed at front end portions of the cover-side slanting portions 18. The wires 40 are adapted to be held between a rear seal portion 21 (defining a rear portion) of the housing-side seal member 10 and the cover-side seal member 11, and in the closed condition of the cover, the wires are pressed and held between the wire support portion 4 and the rear end portion of the cover 8.

Figure 3:
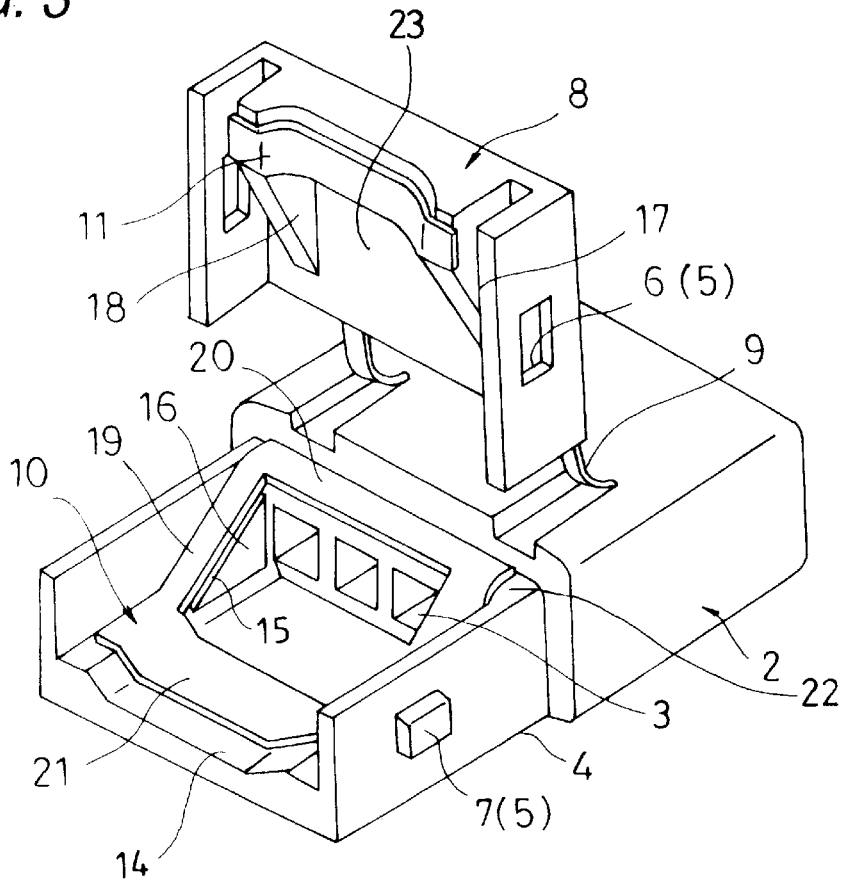
FIG. 3 is a perspective view showing a condition in which seal members are attached respectively to a connector housing and a cover in FIG. 1.

In the waterproof connector 1 of the above construction, first, the rear seal portion 21 of the housing-side seal member 10 is affixed to the bottom plate 14, and the side seal portions 19 are affixed respectively to the slanting surfaces 15 of the housing-side slanting portions 16, as shown in FIG. 3. The front seal portion 20 is affixed to the housing-side pressing portion 22, and the cover-side seal member 11 is affixed to the cover-side pressing portion 23. Preferably, an adhesive or the like is beforehand coated on the reverse surface of the housing-side seal member 10 and the reverse surface of the cover-side seal member 11.

Figure 4:
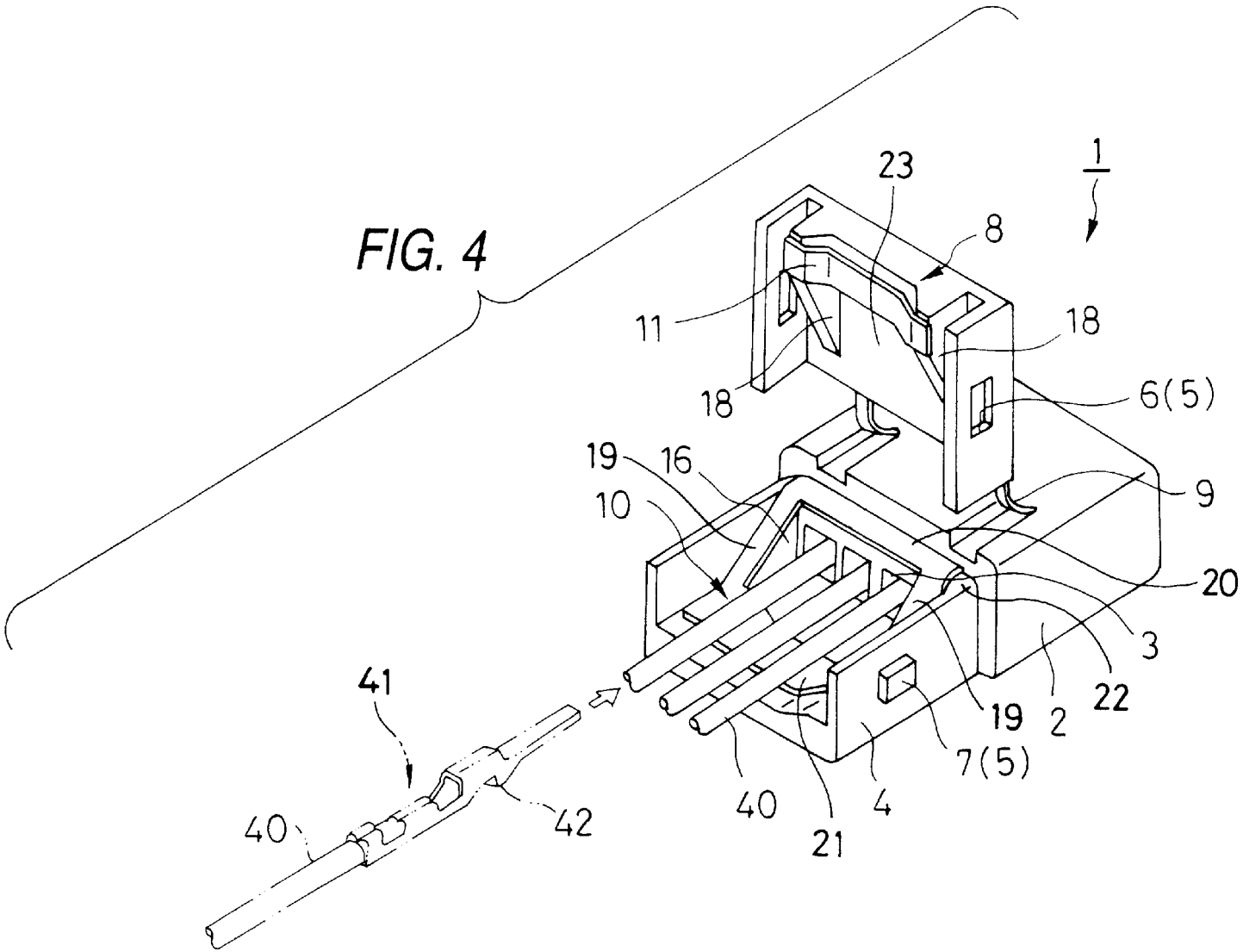
FIG. 4 is a perspective view showing a condition in which connection terminals are inserted respectively in terminal receiving chambers of the waterproof connector shown in FIG. 3.

Then, when the connection terminals 41, fixedly secured respectively to the wires 40, are inserted respectively into the terminal receiving chambers 3 as shown in FIG. 4, the housing lances (not shown) are retainingly engaged respectively in the retaining grooves 42, and also the lower surfaces of the wires 40 are held in contact with the rear seal portion 21 of the housing-side seal member 10.

Then, when the hinge 9 is turned, so that the cover 8 is closed to cover the wire support portion 4, the retaining holes 6 are retainingly engaged with the retaining projections 7, respectively, thus completing the assembling operation of the waterproof connector 1. In this condition, the cover-side seal member 11 is pressed against the upper surfaces of the wires 40, and cooperates with the rear seal portion 21 of the housing-side seal member 10 to firmly hold the wires 40 therebetween.

Each of the side seal portions 19 is firmly pressed and held between the associated housing-side slanting portion 16 and cover-side slanting portion 18, and the front seal portion 20 is firmly pressed and held between the housing-side pressing portion 22 and the cover-side pressing portion 23.

Therefore, the housing-side seal member 10 of a rectangular frame-like shape is firmly pressed and held between the wire support portion 4 and the cover 8 continuously and uniformly over the entire periphery thereof, that is, not only at the side seal portions 19 but also at the front seal portion 20 and the rear seal portion 21. Therefore, a waterproof effect can be positively achieved at the wire support portion 4, forming the rear portion of the connector housing 2, and therefore there can be obtained the waterproof connector 1 of high reliability.

As described above, in the waterproof connector 1 of this embodiment, the housing-side slanting portions 16, each having the slanting surface 15 slanting rearwardly, are respectively formed on the opposite inner side portions on the wire support portion 4, and the cover-side slanting portions 18, each having the slanting surface 17 for surface-to-surface contact with the associated slanting surface 15, are formed respectively on the cover 8. The housing-side seal member 10 has a rectangular frame-like shape, and has the side seal portions (opposite side portions) 19 each adapted to be held between the associated housing-side slanting portion 16 and cover-side slanting portion 18.

Therefore, merely by pressing the cover 8 generally vertically toward the wire support portion 4 so as to retain the cover 8 by the cover retaining portions 5, each of the side seal portions 19 is firmly pressed and held between the associated housing-side and cover-side slanting portions 16 and 18, so that a waterproof effect can be positively achieved at the opposite inner side portions of the wire support portion 4, and therefore there can be obtained the waterproof connector 1 of high reliability.

The front seal portion (front portion) 20 of the housing-side seal member 10 is pressed and held between the housing-side pressing portion 22, interconnecting the front ends of the housing-side slanting portions 16, and the cover-side pressing portion 23 formed at the front end portions of the two cover-side slanting portions 18. The wires 40 are held between the rear seal portion (rear portion) 21 of the housing-side seal member 10 and the cover-side seal member 11, and the wires are pressed and held between the wire support portion 4 and the cover 8.

Therefore, the housing-side seal member 10 of a rectangular frame-like shape is firmly pressed and held between the wire support portion and the cover not only at the side seal portions 19 but also at the front and rear seal portions 20 and 21, and therefore the housing-side seal member 10 ensures the waterproof effect continuously and uniformly over the entire periphery thereof. Therefore, there can be obtained the waterproof connector 1 of higher reliability.

Figure 5:
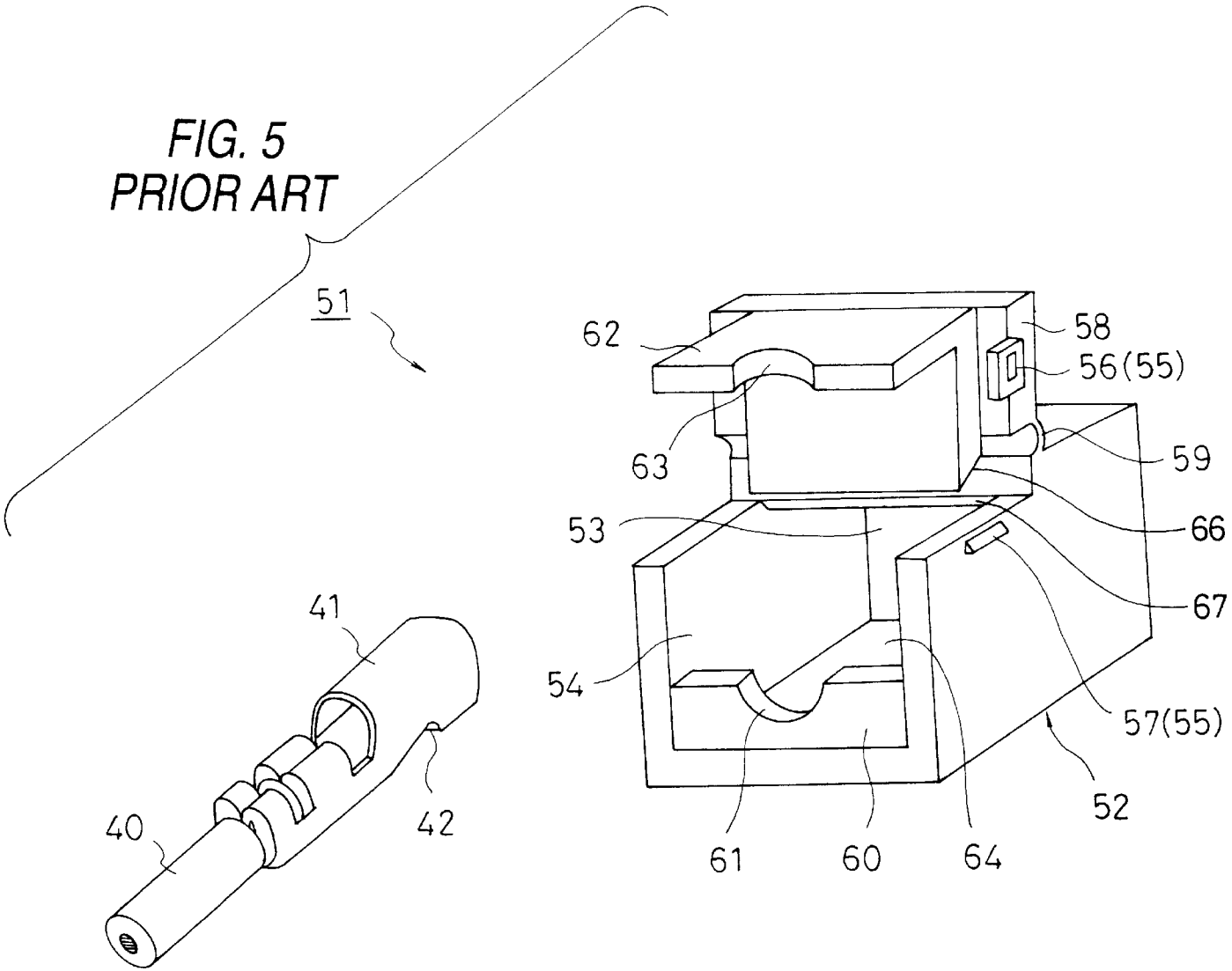
FIG. 5 PRIOR ART
FIG. 5 is an exploded, perspective view of the related waterproof connector.

The present invention is not limited to the above embodiment, but can be directed to other embodiments by making suitable modifications. For example, in this embodiment, although the housing-side seal member 10 has a rectangular frame-like shape, the side seal portions 19, the front seal portion 20 and the rear seal portion 21 may be separate from each other. Although housing-side grooves and cover-side grooves as shown in FIG. 5 are not formed in the rear seal portion 21 of the housing-side seal member 10 and the cover-side seal member 11, such grooves may be provided, depending on the degree of elasticity of the material of which the housing-side seal member 10 and the cover-side seal member 11 are made.

As described above, in the waterproof connector of the present invention, the housing-side slanting portions, each having the slanting surface slanting rearwardly, are respectively formed on the opposite inner side surfaces on the wire support portion, and the cover-side slanting portions, each having the slanting surface for surface-to-surface contact with the slanting surface of the associated housing-side slanting portion, are respectively formed on the cover. The housing-side seal member has the side seal portions each held between the associated housing-side slanting portion and cover-side slanting portion.

Therefore, merely by pressing the cover generally vertically toward the wire support portion so as to retain the cover in its closed position by the cover retaining portions, each of the side seal portions is firmly pressed and held between the associated housing-side and cover-side slanting portions, so that a waterproof effect can be positively achieved at the opposite inner side portions of the wire support portion, and therefore there can be obtained the waterproof connector of high reliability.

In the closed condition of the cover, the front seal portion (front portion) of the housing-side seal member is pressed and held between the housing-side pressing portion, interconnecting the front ends of the housing-side slanting portions, and the cover-side pressing portion formed at the front end portions of the cover-side slanting portions. The wires, connected respectively to the rear end portions of the connection terminals, are held between the rear seal portion (rear portion) of the housing-side seal member and the cover-side seal member, and the wires are pressed and held between the wire support portion and the cover.

Therefore, the housing-side seal member is firmly pressed and held between the wire support portion and the cover not only at the side seal portions but also at the front and rear seal portions, and therefore the housing-side seal member positively achieves the waterproof effect, and there can be obtained the waterproof connector of higher reliability.

What is claimed is:

1. A waterproof connector, comprising:

a connector housing including a terminal receiving chamber for receiving a connection terminal secured to an end portion of a wire, and a wire support portion rearwardly extending from the terminal receiving chamber;

a cover which covers the wire support portion, and is retained on the connector housing by a cover retaining portion;

at least two housing-side slanting portions, between which the wire is arranged, each having a slanting surface, the housing-side slanting portions being formed on the wire support portion;

at least two cover-side slanting portions each having a slanting surface, the cover-side slanting portions being formed on the cover;

a cover-side seal member attached to the cover; and a housing-side seal member attached to the wire support portion, the housing-side seal member including a first seal portion which is associated with the cover-side seal member so as to hold the wire therebetween, and side seal portions respectively pressed and held between the housing-side slanting portions and the cover-side slanting portions.

2. The waterproof connector of claim 1, wherein the cover-side seal member is located at a rear end portion of the cover.

3. The waterproof connector of claim 1, further comprising:

a housing-side pressing portion interconnecting front ends of the housing-side slanting portions; and a cover-side pressing portion formed on the cover, wherein the housing-side seal member further includes a second seal portion, the second seal portion is pressed and held between the housing-side pressing portion and the cover-side pressing portion.

4. The waterproof connector of claim 3, wherein the first seal portion interconnects rear end portions of the side seal portions of the housing-side seal member, and the second seal portion interconnects front end portions of the side seal portions of the housing-side seal member.

5. The waterproof connector of claim 1, wherein the first seal portion interconnects rear end portions of the side seal portions of the housing-side seal member.

* * * * *